United States Patent [19]

Dixon

[11] 4,045,930

[45] Sept. 6, 1977

[54] FIRE RESISTANT SEALS

[75] Inventor: Bernard Dixon, Pampisford, England

[73] Assignee: Dixon International Limited, Great Britain

[21] Appl. No.: 744,736

[22] Filed: Nov. 24, 1976

[30] Foreign Application Priority Data

Nov. 27, 1975 United Kingdom ..... 48795/75

[51] Int. Cl.[2] ..... E16J 15/00; E06B 7/16

[52] U.S. Cl. ..... 52/232; 49/475; 49/504; 277/237 R

[58] Field of Search ..... 49/475, 493, 467, 469, 49/489, 504; 52/232, 204, 317; 277/237 R

[56] References Cited

U.S. PATENT DOCUMENTS

| | | | |
|---|---|---|---|
| 3,426,491 | 2/1969 | Gaeta et al. | 52/232 X |
| 3,566,541 | 3/1971 | Coulter | 49/475 |
| 3,955,330 | 5/1976 | Wendt | 52/232 X |
| 3,964,214 | 6/1976 | Wendt | 52/232 X |

FOREIGN PATENT DOCUMENTS

| | | | |
|---|---|---|---|
| 2,286,991 | 4/1976 | France | 49/475 |

*Primary Examiner*—Philip C. Kannan

*Attorney, Agent, or Firm*—Stevens, Davis, Miller & Mosher

[57] ABSTRACT

A fire-resistant seal for gaps between a door or window and adjacent structure, comprises a tubular holder which contains a fire-resistant barrier material and has a lengthwise opening through which the material can exude when the holder is subjected to hot smoke or fire. To protect the material against a tamperer who inserts a probe into the opening, a baffle surface, which is coextensive with the opening, is provided inside the holder. The baffle surface forms with adjacent surfaces of the holder a strait which extends between the opening and the interior of the holder where the material is retained. The holder may also support an elastomeric draught excluder.

8 Claims, 5 Drawing Figures

FIRE RESISTANT SEALS

This invention relates to the application of material which swells when exposed to hot smoke or flame, and in the intumesced state constitutes a fire-resistant barrier. Such material is referred to in this specification as fire-resistant barrier material. This material has been used to form a fire-resistant barrier in gaps, e.g. between a door and adjacent structure, e.g. the jamb, and correspondingly with respect to a window.

In our Complete Specification, filed in respect of British patent applications Nos. 42584/74 and 9166/75 and 31219/75, we have described a fire-resistant seal for application to a structure comprising an elongate holder for securing thereto, and fire-resistant barrier material, as above referred to, retained in the holder. The holder is preferably formed with an opening which extends throughout the length of the holder, through which opening the material effuses during intumescence. Alternatively a foil is provided which seals the opening; or, in place of the opening, a line of weakening is provided in the wall of the holder, the foil or weakened wall rupturing under pressure from the material when it swells under fire conditions.

With the object of improving protection for the material against tampering, for example by a probe pushed in through the opening, and improving mechanical support and retention of the material in the holder over time and against accidental blows after installation, we provide according to the present invention, a fire-resistant seal comprising a holder of substantially tubular form for securing to the structure, and a fire-resistant barrier material, which swells under fire conditions, retained in a chamber in the holder, the holder having an external elongate opening extending therealong, and a baffle surface extending within the holder and forming with the holder interior adjacent to the baffle surface a strait being coextensive with the length of the opening.

Preferably the strait changes direction between the external opening and the chamber. The baffle surface may be provided by a projection on the holder interior.

The invention further comprises a method of manufacturing the seal. The method may comprise loading the holder with the material before making the opening or when the opening is sealed, and thereafter making or unsealing the opening. Preferably the material is loaded in a liquid or in a paste condition, the material being allowed or caused to set in the holder before making or unsealing the opening.

Examples embodying the invention will now be described with reference to the accompanying drawing, in which.

In the drawing, corresponding references have been used on corresponding parts.

Figure 1:
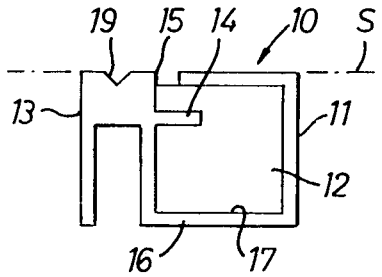
FIG. 1 is an end view of one form of fire-resistant seal.

Referring to FIG. 1, the fire-resistant seal comprises an elongate holder 10 having a substantially tubular, box-section portion 11 filled with fire-resistant barrier material 12, and a foot portion 13 by which the seal is attachable, using pins, to a structure.

The box-section portion 11 is formed with a ward or baffle 14, which is a projection extending internally throughout the length of the holder 10, and an external elongate opening 15, which is also co-extensive with the length of the holder. The baffle 14 projects away from the foot portion 13 to intervene between the opening 15 to which the baffle 14 is adjacent, and the base wall 16 of the box-section portion 11 which is disposed opposite to the opening, The baffle 14 exceeds the width of the opening 15 to protect and retain the material 12 disposed in a chamber 17 between the baffle 14 and the base wall 16, and to the right of the free extremity of the baffle as shown. The baffle 14, being disposed close to the opening 15, also tends to protect the material 12 which is not directly opposite the opening, i.e. to the right of the baffle 14, against a probe which may be pushed through the opening by a tamperer.

Figure 2:
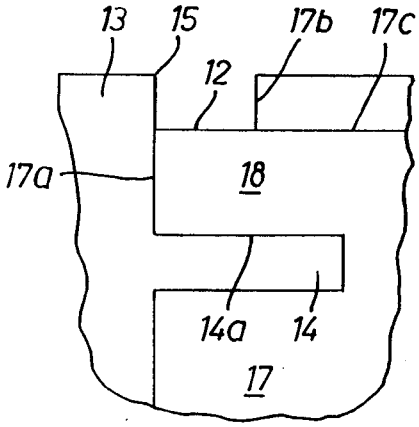
FIG. 2 is an enlarged fragment of FIG. 1.

The baffle 14 and adjacent surfaces are described in more detail with reference to FIG. 2. The upper surface 14*a* of the baffle forms with the adjacent interior surfaces of the holder, a strait 18, which changes direction between the external opening 15 and the free extremity of the baffle 14 at which the strait 18 ends. The surfaces defining the strait 18 are surface 17*a*, which extends from the baffle 14 to the opening 15; surface 17*b* which is opposite surface 17*a* at the opening 15; and surface 17*c* which is directly opposite the baffle surface 14*a*. The strait 18 is co-extensive with the length of the opening 15.

The foot portion 13 is formed in its crown with a small V-groove 19 for guiding a countersink drill or the point of securing pin, the shank of the pin, when the groove has been pierced, extending between a wall of the foot portion 13 and an adjacent wall of the box-section portion 11.

Figure 3:
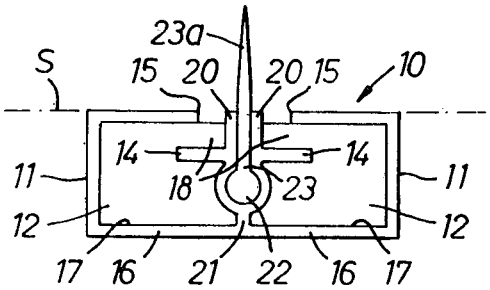
FIG. 3 is a similar view of a second form of fire-resistant seal which is also a draught excluder.

FIG. 3 shows a second form of fire seal. The holder 10 has two box-section portions 11 with respective baffles 14 and external openings 15, and containing fire-resistant barrier material 12. There is, however, no equivalent of the foot portion 13, FIG. 1, the holder 10 in FIG. 3 being securable to a structure by application of adhesive to the outside of the base walls 16.

The box-section portions 11 are separated by essentially a double wall portion or groove 20 the walls thereof having a common origin 21 at the base walls 16 and each bearing its respective baffle 14. Between the origin 21 and the baffles 14, the member walls of the partition 20 define a part-cylindrical space between them in which is retained a correspondingly formed bead 22 of an elastomeric seal 23. A blade portion 23*a* of the elastomeric seal 23 extends up between an upper parallel portion of the walls of the partition 20 and protrudes beyond the holder 10, thus enabling this form of fire-resistant seal to act as an everyday draught excluder.

Figure 4:
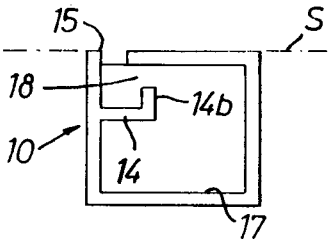
FIGS. 4 and 5 are end views of further forms of fire-resistant seal.

The seal 10 in FIG. 4 is basically similar to the seal in FIG. 1 but is without the foot portion 13. The free end of the baffle 14 in FIG. 4 changes direction abruptly being directed towards the opening 15 as an upwardly directed extension 14*b* which extends throughout the length of the holder 10. The presence of the extension 14*b* tends to guard the chamber 17 against a probe pushed through the opening, either by engagement with the probe or by restricting entry by constricting the width of the strait 18.

Figure 5:
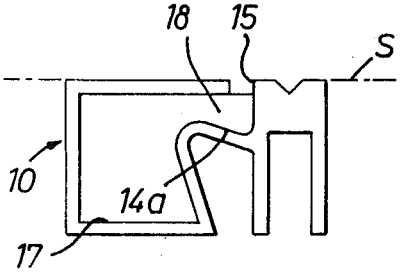

The seal in FIG. 5 is a modification of the seal in FIG. 1, there being a baffle surface 14*a*, in FIG. 5 provided by the wall of the box-section 11 instead of by a projection from it.

The holders 10 described with reference to FIGS. 1 to 4 are formed by extrusion and may consist of aluminium; or of thermoplastics which, when moulded in the form of any of the holders 10, may show signs of softening at 100° C but is self-supporting up to at least that temperature.

The material 12 may conveniently be the mixture V described in the above-mentioned Complete Specification namely:

| | % by weight |
|---|---|
| Diammonium phosphate | 20.8 |
| Monoammonium phosphate | 20.8 |
| Urea | 8.3 |
| Titanium dioxide | 8.3 |
| Sucrose | 8.3 |
| Urea formaldehyde resin | 16.8 |
| Water | 16.7 |
| | 100.0 |

The above mixture is liquid. The liquid is pumped into one-metre lengths of any form of the box-section portion 11 of the holder 10 shown before cutting the opening 15 e.g. by a milling cutter, the holder 10 being held upright during pumping the liquid which is being introduced at the lower end. If the opening 15 has already been formed, the opening is temporarily sealed, e.g. by the appliction of a pad external to the holder 11, before loading and thereafter unsealing by removal of the pad. The liquid sets after standing several hours. Thereafter the opening 15 is cut or unsealed, and with regard to FIG. 3, the elastomeric seal 23 is slid in place between the walls 20 in the holder 10.

In application, all forms of holder 10 shown in the drawing are inlaid in prepared grooves made in a wooden door case or corresponding window structure, and secured, the surface of the structure being indicated by the broken line S.

Under fire conditions, heat by conduction or radiation reaches the fire-resistant barrier material 12. The material intumesces and effuses from the box-section portion 11, including the chamber 17, through the strait 18 and the opening 15. Even should the baffle 14 become bent upward under pressure by intumescence of the material, which may be 2 or 3 atmospheres per $cm^2$, the opening 15 will not seriously be obstructed because the pressure will also tend to force the upper wall of the box-portion 11 outwards.

Under fire conditions the elastomeric seal 23 (FIG. 3) is destroyed but the holder 10 is remarkably protected by the wood in which it is embedded and by the intumescent material 12 which tends to clad the holder.

I claim:

1. A fire-resistant seal for application to a structure, comprising a holder of substantially tubular form for securing to the structure, the holder having an external elongate opening extending therealong, a chamber defined by the interior of the holder, a fire-resistant barrier material which swells under fire-conditions, retained in said chamber in the holder, and a baffle surface extending within the holder and forming with the holder interior adjacent to the baffle surface a strait which extends between the opening and the chamber, the strait being co-extensive with the length of the opening.

2. A fire-resistnt seal according to claim 1, in which the strait changes direction between the external opening and the chamber.

3. A fire-resistant seal according to claim 2, in which the baffle surface is provided by a projection on the holder interior.

4. A fire-resistant seal according to claim 3, in which the projection intervenes between the opening and an interior surface of the holder disposed opposite the opening.

5. A fire-resistant seal according to claim 4, in which the projection has a free end portion directed towards the opening and thereby constricts the width of the strait, the projection changing direction abruptly at the free end portion.

6. A fire-resistant seal according to claim 1 in which the holder is formed with a groove extending alongside the opening, and an elastomeric draught excluding member is retained in and protrudes from the groove.

7. A fire-resistant seal according to claim 1, in which the holder is an extrusion of good thermal conductivity.

8. A fire-resistant seal according to claim 1 in which the holder is an extrusion of thermoplastics, which holder is self-supporting up to at least 100° C.

* * * * *